US009277777B2

(12) United States Patent
Lee et al.

(10) Patent No.: US 9,277,777 B2
(45) Date of Patent: Mar. 8, 2016

(54) ATTACHING DEVICE FOR EXTENSION EYELASHES

(71) Applicant: UNIST ACADEMY-INDUSTRY RESEARCH CORPORATION, Ulsan (KR)

(72) Inventors: Myun-Woo Lee, Seoul (KR); A. B. Radjiyeb, Ulsan (KR); Hyung-Cheol Min, Seoul (KR); Ji-Yoon Han, Seoul (KR); Do-Young Kim, Gwangju (KR)

(73) Assignee: UNIST ACADEMY-INDUSTRY RESEARCH CORPORATION, Ulsan (KR)

( * ) Notice: Subject to any disclaimer, the term of this patent is extended or adjusted under 35 U.S.C. 154(b) by 0 days.

(21) Appl. No.: 14/394,835

(22) PCT Filed: Oct. 26, 2012

(86) PCT No.: PCT/KR2012/008889
§ 371 (c)(1),
(2) Date: Oct. 16, 2014

(87) PCT Pub. No.: WO2013/157710
PCT Pub. Date: Oct. 24, 2013

(65) Prior Publication Data

US 2015/0075549 A1 Mar. 19, 2015

(30) Foreign Application Priority Data

Apr. 17, 2012 (KR) ..... 10-2012-0039937

(51) Int. Cl.
*A45D 40/30* (2006.01)
*A41G 5/02* (2006.01)
*A45D 44/00* (2006.01)

(52) U.S. Cl.
CPC *A41G 5/02* (2013.01); *A45D 44/00* (2013.01); *A45D 2200/155* (2013.01)

(58) Field of Classification Search
CPC .... A41G 5/02; A45D 44/00; A45D 2200/155
See application file for complete search history.

(56) References Cited

U.S. PATENT DOCUMENTS 3,478,754 A * 11/1969 Martin, Jr. ..... 132/216
3,556,113 A * 1/1971 Frieder ..... 132/216

FOREIGN PATENT DOCUMENTS

JP 2011-005013 1/2011
JP 2011-087658 5/2011

(Continued)

*Primary Examiner* — Rachel Steitz

(74) *Attorney, Agent, or Firm* — Duane Morris LLP; J. Rodman Steele, Jr.; Gregory M. Lefkowitz

(57) ABSTRACT

Disclosed herein is an attaching device for extension eyelashes adapted to attach false eyelashes to natural eyelashes by overlapping the false eyelashes containing an adhesive with the natural eyelashes and applying heat to the adhesive. The device includes a body defining a space therein and shaped to be held by a hand. A support is formed on an end of the body to support the false eyelashes. An inner grip is shaped to surround the support, and grips the natural eyelashes and the false eyelashes. An outer grip is shaped to surround the inner grip, further grips the natural eyelashes and the false eyelashes that are gripped by the inner grip, and applies heat to the adhesive contained in the false eyelashes. A manipulating portion is slidably coupled to an exterior of the body and moved to sequentially operate the inner grip and the outer grip.

8 Claims, 7 Drawing Sheets

(56) References Cited

FOREIGN PATENT DOCUMENTS

| | | |
|---|---|---|
| JP | 2012-072510 | 4/2012 |
| KR | 2001654520000 | 10/1999 |
| KR | 2003343620000 | 11/2003 |
| KR | 10200397724 | 12/2003 |
| KR | 2003699370000 | 12/2004 |
| KR | 1020050094973 | 9/2005 |
| KR | 1013230760000 | 10/2013 |

* cited by examiner

ATTACHING DEVICE FOR EXTENSION EYELASHES

CROSS-REFERENCE TO RELATED APPLICATIONS

This application is a §371 national stage entry of International Application No. PCT/KR2012/008889, filed Oct. 26, 2012, which claims priority to South Korean Patent Application No. 10-2012-0039937 filed Apr. 17, 2012, the entire contents of which are incorporated herein by reference.

TECHNICAL FIELD

The present invention relates, in general, to an attaching device for extension eyelashes and, more particularly, to an attaching device for extension eyelashes that is capable of conveniently and precisely attaching the extension eyelashes.

BACKGROUND ART

Eyelashes play an important role in aesthetic appearance. Particularly, women prefer long and curled eyelashes. In order to make such a shape of the eyelashes, mascara is usually utilized.

Mascara functions to make the eyelashes into a desired shape and to make up the eyelashes of the desired shape black. Since mascara is most convenient to make up the eyelashes, it is widely used.

The above-mentioned method is generally applied to long eyelashes to create more beautiful eyelashes. However, in the case where the eyelashes are short, a method wherein separate false eyelashes are attached to enhance aesthetic appearance is utilized.

The false eyelash consists of a lash portion and a base portion, and is attached to the eyelid after an adhesive is applied to the base portion.

The false eyelashes are problematic in that a user should elaborately attach them to the eyelid in person, so that it takes a long time for an unskilled user to attach the eyelashes and thereby it is very inconvenient to use. In order to overcome the problem, Korean U.M. Registration No. 165452 has been proposed, which enables a user to easily attach the eyelashes.

Such false eyelashes are superior in enhancing aesthetic appearance. However, the false eyelashes are problematic in that they are disposable, so that new false eyelashes should always be used when necessary. Further, while a user is out, she should carry the false eyelashes.

On one hand, if a user's eyelashes are short, an eyelash extension procedure as well as the false eyelashes can be used. The eyelash extension procedure is usually performed in a skin care shop or a beauty shop, and is designed to attach separate extension eyelashes to some natural eyelashes via the adhesive. The eyelash extension procedure is advantageous in that it can create long eyelashes, and is maintained for several months after a single procedure, so that the eyelash extension procedure is widely used. According to the prior art, many methods of attaching the extension eyelashes have been proposed.

For example, Japanese Patent Laid-Open Publication No. 2011-87658 discloses a method of extending the eyelashes using an adhesive that acts under a specific optical wavelength. This method is advantageous in that the function of the adhesive is implemented at the specific optical wavelength, thus making it convenient to perform the extension using the adhesive.

Further, Korean Patent Laid-Open Publication No. 2005-94973 discloses an eyelash perm method.

This perm method is performed by attaching extension eyelashes and then setting the entire eyelashes. This is advantageous in that a user has only to make up the eyelashes in black simply using mascara after the perm, so that it shortens a time to make up the eyelashes, and the shape of the eyelashes is maintained for a relatively long period of time with a single procedure.

Such an extension procedure is advantageous in that it enhances aesthetic appearance in case of the short eyelashes. However, this is problematic in that every extension procedure is performed manually, so that it requires a large amount of time. Further, this is performed in a separate shop, so that it is impossible for a user to perform the procedure in person.

Therefore, there is a need for a new attaching device that can rapidly perform the eyelash extension procedure which is performed manually in the prior art, and enables one to perform the procedure by oneself.

Due to such a need, the applicant of this invention filed Korean Patent Appl. No. 2012-0003537 on Jan. 11, 2012, which is entitled "Attaching Device for Extension Eyelashes".

The above invention proposed a basic configuration as the first application for an extension eyelash procedure, and is advantageous in that it is efficient in most cases. However, this is problematic in that some adhesive attached to the false eyelashes is transferred to the attaching device when it is continuously used, so that the adhesive may hinder the procedure.

Therefore, an attaching device wherein a grip structure is added to the conventional device so as to enhance the operational accuracy of the attaching device and improve marketability is required.

DISCLOSURE

Technical Problem

Accordingly, the present invention has been made keeping in mind the above problems occurring in the prior art, and an object of the present invention is to provide a novel attaching device for extension eyelashes, intended to allow adhesive-backed extension eyelashes to be conveniently and rapidly attached to the natural eyelashes, and to ensure the accuracy of a procedure.

Technical Solution

In order to accomplish the above object, the present invention provides an attaching device for extension eyelashes adapted to attach false eyelashes to natural eyelashes by overlapping the false eyelashes containing an adhesive with the natural eyelashes and applying heat to the adhesive, the device including a body defining a space therein, and shaped to be held by a hand; a support formed on an end of the body to support the false eyelashes; an inner grip shaped to surround the support, and gripping the natural eyelashes and the false eyelashes; an outer grip shaped to surround the inner grip, and further gripping the natural eyelashes and the false eyelashes that are gripped by the inner grip, the outer grip applying heat to the adhesive contained in the false eyelashes; and a manipulating portion slidably coupled to an exterior of the body, and moved to sequentially operate the inner grip and the outer grip.

Preferably, the inner grip may include an upper inner grip including a rotary hole that is rotatably coupled to an upper protrusion formed on the body; a lower inner grip including a rotary hole that is rotatably coupled to a lower protrusion formed on the body; an inner grip lever formed on an end of the upper inner grip; and an inner grip gear formed on each of contact portions of the upper inner grip with the lower inner grip, the inner grip lever rotating in a direction of closing the upper inner grip and the lower inner grip relative to each other, in conjunction with a forward movement of the manipulating portion.

More preferably, the attaching device may further include a rotary spring provided between the upper inner grip and the body, or between the upper inner grip and the lower inner grip, the rotary spring keeping the upper inner grip and the lower inner grip open if there is no additional manipulation.

More preferably, the outer grip may include an upper outer grip including a rotary hole that is rotatably coupled to an upper protrusion formed on the body; a lower outer grip including a rotary hole that is rotatably coupled to a lower protrusion formed on the body; an outer grip lever formed on an end of the upper outer grip; and an outer grip gear formed on each of contact portions of the upper outer grip with the lower outer grip, the outer grip lever rotating in a direction of closing the upper outer grip and the lower outer grip relative to each other, in conjunction with a forward movement of the manipulating portion.

More preferably, the attaching device may further include a rotary spring provided between the upper outer grip and the body, or between the upper outer grip and the lower outer grip, the rotary spring keeping the upper outer grip and the lower outer grip open if there is no additional manipulation.

Preferably, each of the inner grip gear and the outer grip gear may include a plurality of gears, the outer grip gear being at an outer position and the inner grip gear being at an inner position in a longitudinal direction of the protrusion.

Preferably, the manipulating portion may include an upper pressurizing portion and a lower pressurizing portion, the upper pressurizing portion coming into contact with the outer grip lever, the lower pressurizing portion coming into contact with the inner grip lever.

More preferably, if the manipulating portion moves forwards, the lower pressurizing portion may first come into contact with the inner grip lever and then the upper pressurizing portion may come into contact with the outer grip lever.

More preferably, the lower pressurizing portion may be deformed when the inner grip lever is not rotated any more, thus increasing a gripping force of the inner grip.

Preferably, the adhesive may be applied to ends of the false eyelashes located on the support, the false eyelashes being positioned between an upper member and a lower member to be held by a coupling force of the upper member with the lower member.

More preferably, the lower member may be fastened to the support in a slidable manner, the lower member and the upper member being coupled to each other through press fitting.

More preferably, a projecting portion may be formed on a side of the lower inner grip, and a side of the upper member may be formed to protrude, so that when the lower inner grip is closed, the upper member may be separated from the lower member by the projecting portion.

Advantageous Effects

An attaching device for extension eyelashes according to the present invention is advantageous in that an eyelash extension procedure that was performed manually according to the prior art can be carried out with simple manipulation, thus allowing the eyelash extension procedure to be rapidly performed, and enabling one to conveniently perform the eyelash extension procedure by oneself, and in that a precise operation is guaranteed, thus shortening a time required for the eyelash extension procedure, and moreover improving marketability.

MODE FOR INVENTION

Hereinafter, the present invention will be described in detail with reference to the accompanying drawings.

Figure 1:
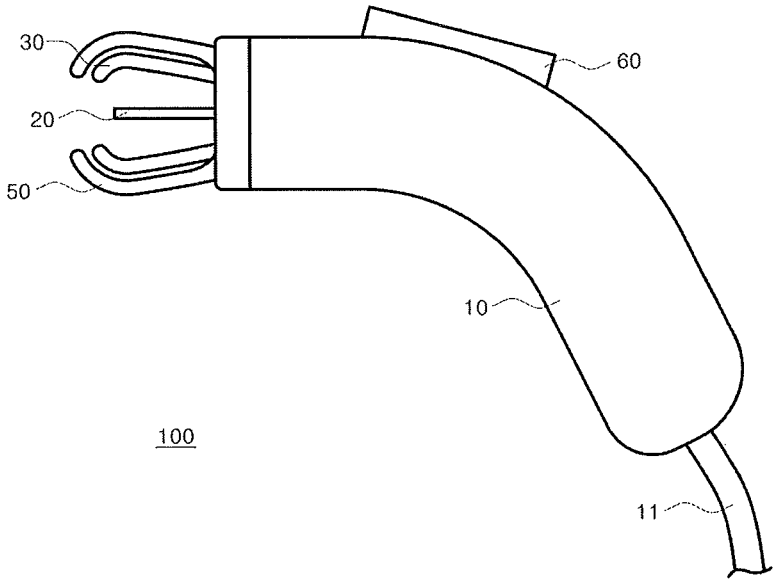
FIG. 1 is a front view showing an attaching device for extension eyelashes according to the present invention.

As shown in FIG. 1, an attaching device 100 for extension eyelashes according to the present invention includes a body 10, a support 20, an inner grip 30, an outer grip 50, and a manipulating portion 60.

First, the body 10 defines a space therein, with several members positioned in the space. A power cord 11 is connected to the body to generate heat. If necessary, a battery may be installed in the body so that the body has a rechargeable structure.

The body 10 may have any shape as long as it may be gripped. The support 20 is located on an end of the body.

The natural eyelashes 1 which are to be extended are disposed on the support 20. Further, false eyelashes 2 to which an adhesive 3 is applied are positioned to overlap the natural eyelashes 1.

Figure 2:
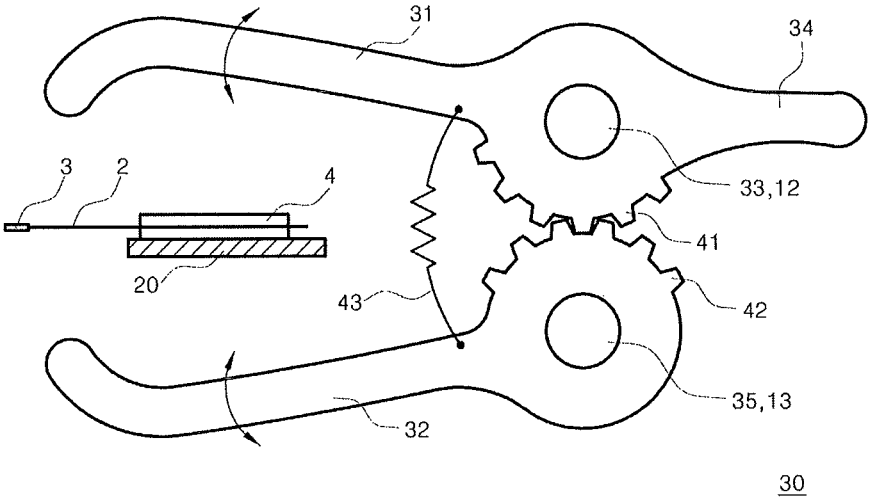
FIG. 2 is a view illustrating a configuration of an inner grip of FIG. 1.

As shown in FIG. 2, the body 10 includes therein an inner grip 30 composed of an upper inner grip 31 and a lower inner grip 32, and interlocking members for interlocking the inner grip 30.

First, a rotary hole 33 is formed at a position of the upper inner grip 31, and a cylindrical upper protrusion 12 provided in the body 10 is rotatably secured to the rotary hole 33.

The upper inner grip 31 rotates about the rotary hole 33. A left side of the rotary hole serves to hold the eyelashes, while an inner grip lever 34 is formed on a right side thereof.

Meanwhile, a rotary hole 35 is also formed at a position of the lower inner grip 32. A cylindrical lower protrusion 13 formed in the body 10 is rotatably secured to the rotary hole 35.

The lower protrusion 13 has the same size as the upper protrusion 12.

Since the upper inner grip 31 and the lower inner grip 32 should be implemented to have the same movement with reference to the support 20, the rotary hole 33 and the rotary hole 35 are located at corresponding positions above and below the support 20, and the upper protrusion 12 and the lower protrusion 13 are also located at corresponding positions.

Further, the upper inner grip 31 and the lower inner grip 32 are provided, respectively, on the left sides of the rotary hole 33 and the rotary hole 35 in such a way as to be symmetrical with respect to the support 20.

Moreover, inner grip gears 41 and 42 are formed, respectively, on ends of the upper inner grip 31 and the lower inner grip 32, the inner grip gears 41 and 42 engaging with each other.

Preferably, two inner grip gears 41 and 42 are axially formed on the upper protrusion 12 and the lower protrusion 13.

Thus, when the upper inner grip 31 rotates about the rotary hole 33, the lower inner grip 33 also rotates in an opposite direction at the same rotating angle.

Further, the upper inner grip 31 is connected at a portion thereof to the body 20 or the lower inner grip 32 via an inner grip spring 43, thus maintaining an open state when a load is not exerted. If necessary, the inner grip spring 43 may be provided on each of the upper inner grip 31 and the lower inner grip 32 in such a way as to be secured to the body 10.

Figure 3:
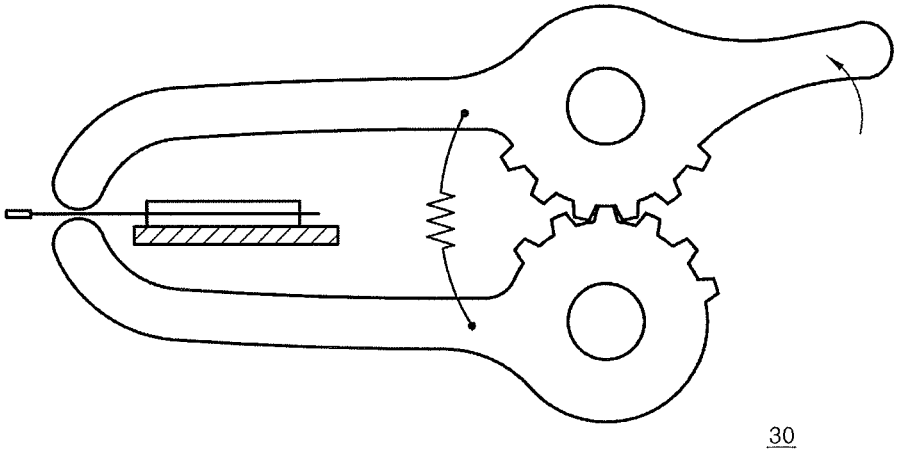
FIG. 3 is a view illustrating a state in which the inner grip of FIG. 2 is closed.

If a load is exerted on the inner grip lever 34 formed on the upper inner grip 31, the upper inner grip 31 is rotated in a closing direction, as shown in FIG. 3.

Meanwhile, the outer grip 50 is equal in structure to but is different in size from the inner grip 30.

Figure 4:
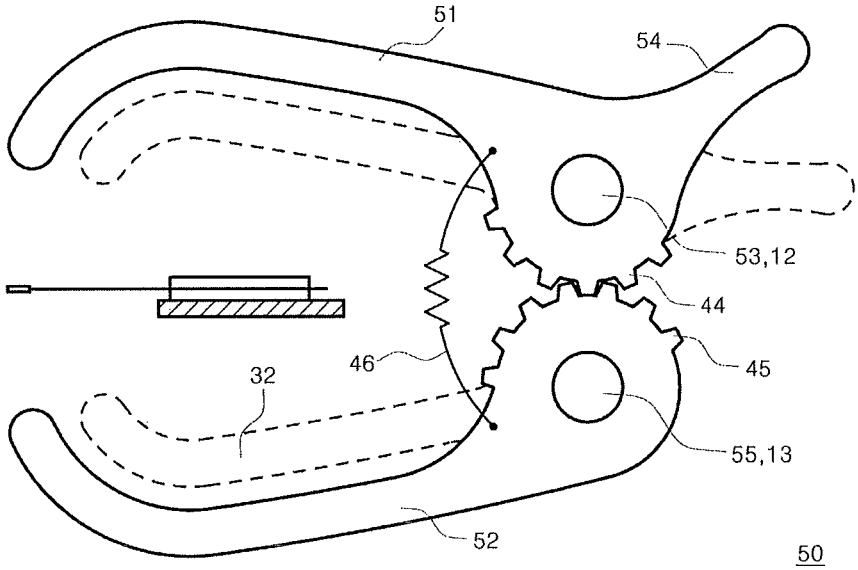
FIG. 4 is a view illustrating a configuration of an outer grip of FIG. 1.

As shown in FIG. 4, the outer grip 50 is configured to surround the inner grip 30, and is also composed of an upper outer grip 51 and a lower outer grip 52.

A rotary hole 53 is formed at a position of the upper outer grip 51, and the upper protrusion 12 is rotatably secured to the rotary hole 53.

Further, an outer grip lever 54 is provided on a right side of the upper outer grip 51 to bear a load from an external member, and a left side thereof is shaped to be gripped.

Furthermore, a rotary hole 55 is also formed at a position of the lower outer grip 52, and a left side thereof is shaped to be gripped in the same manner as the upper outer grip 51.

Also, the lower protrusion 13 is coupled to the rotary hole 55, so that the lower outer grip 52 is also coupled to the body 10 in such a way as to rotate about the lower protrusion 13.

Outer grip gears 44 and 45 are provided on ends of right sides of the upper outer grip 51 and the lower outer grip 52 in such a way as to engage with each other. As the upper outer grip 51 rotates, the lower outer grip 52 is also rotated via the outer grip gears 43 and 44.

Further, an outer grip spring 46 is positioned between the upper outer grip 51 and the body 10 or between the upper outer grip 51 and the lower outer grip 52 to maintain an open state when a load does not act on the outer grip 50.

If necessary, the outer grip spring 46 may be further provided between the lower outer grip 52 and the body 10 to increase a spring force.

Figure 5:
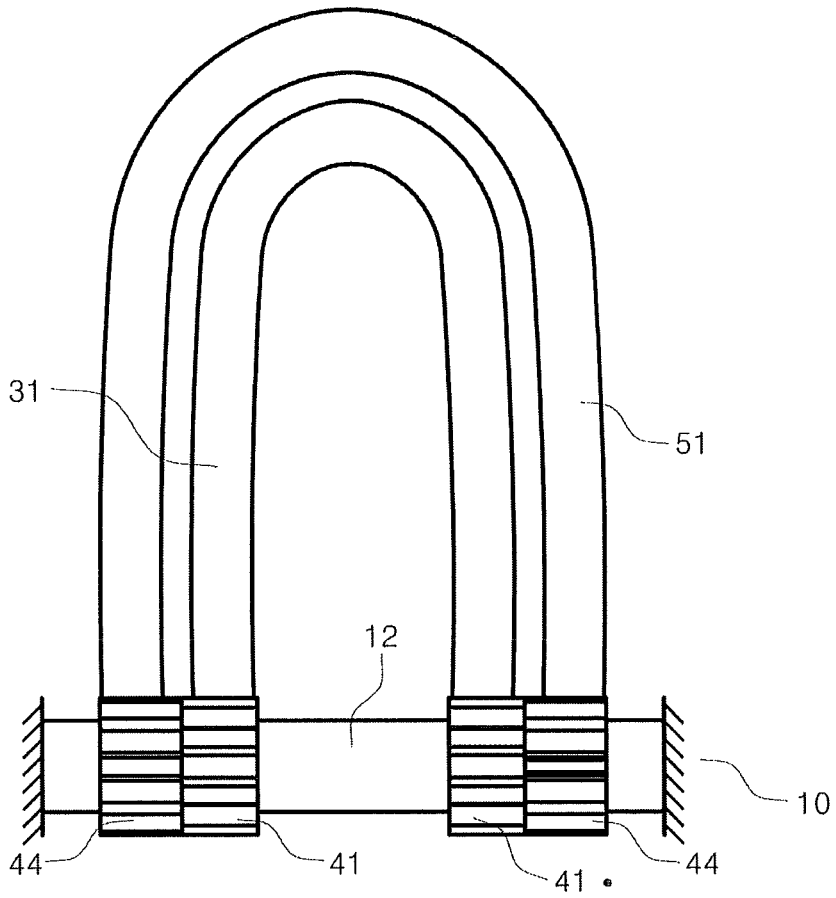
FIG. 5 is a bottom view illustrating an arrangement of the inner and outer grips of FIG. 1.

Meanwhile, since both the upper inner grip 31 and the upper outer grip 51 are rotatably secured to the upper protrusion 12, the upper inner grip and the upper outer grip are arranged as shown in FIG. 5 so that a width is appropriately adjusted and thereby the two elements are rotatably secured simultaneously.

Of course, the lower inner grip 32 and the lower outer grip 53 are also arranged relative to the lower protrusion 13, in the same manner as the upper protrusion 11.

Figure 6:
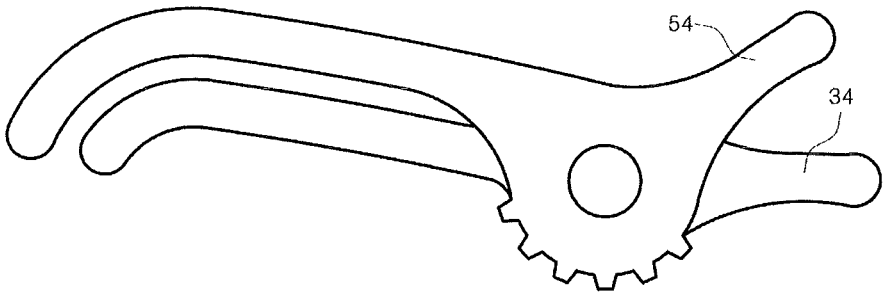
FIG. 6 is a view illustrating an arrangement of an outer grip lever and an inner grip lever of FIG. 1.

Meanwhile, when a load acts on the inner grip lever 34 and the outer grip lever 54, the inner grip 30 and the outer grip 50 should be closed. Further, since the inner grip 30 is first closed and then the outer grip 50 is closed, the inner grip lever 34 and the outer grip lever 54 are arranged as shown in FIG. 6.

In other words, preferably, the inner grip lever 34 is formed to be longer than the outer grip lever 54, and is more inclined to the left.

Figure 7:
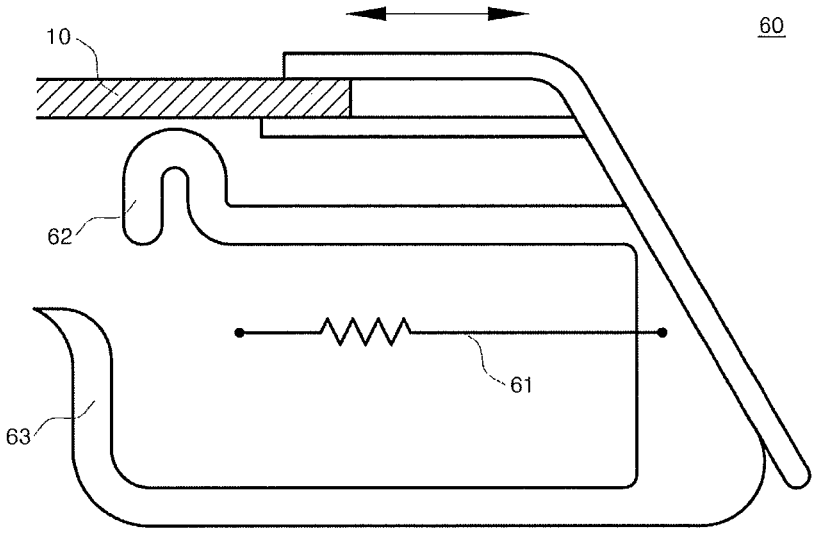
FIG. 7 is a view illustrating a configuration of a manipulating portion of FIG. 1.

Meanwhile, the manipulating portion 60 is further provided on an exterior of the body 10 in such a way as to slide towards the support 20, and is connected to the body 10 via a spring 61 as shown in FIG. 7.

When a load is exerted to move the manipulating portion 60 towards the support 20, the spring 61 generates a compressive force. In contrast, when the load is eliminated, the spring 61 serves to restore the manipulating portion 60 to its original position.

Further, the manipulating portion 60 includes an upper pressurizing portion 62 and a lower pressurizing portion 63. The lower pressurizing portion 63 is formed to be longer than the upper pressurizing portion 62. The manipulating portion is shaped to be partially bendable.

Here, the upper pressurizing portion 62 serves to close the outer grip 50 when coming into contact with the outer grip lever 54. The lower pressurizing portion 63 serves to close the inner grip 30 when coming into contact with the inner grip lever 34.

Figure 8:
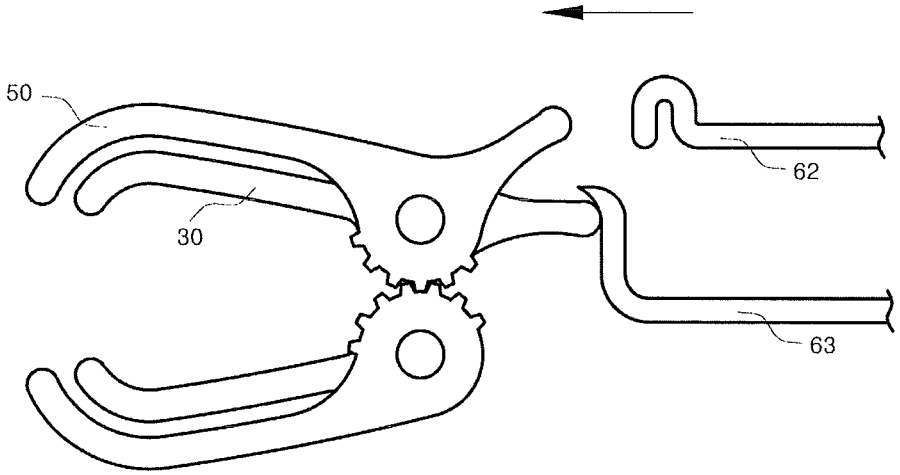
FIG. 8 is a view illustrating an operation of the inner and outer grips by the movement of the manipulating portion of FIG. 1.
Figure 9:
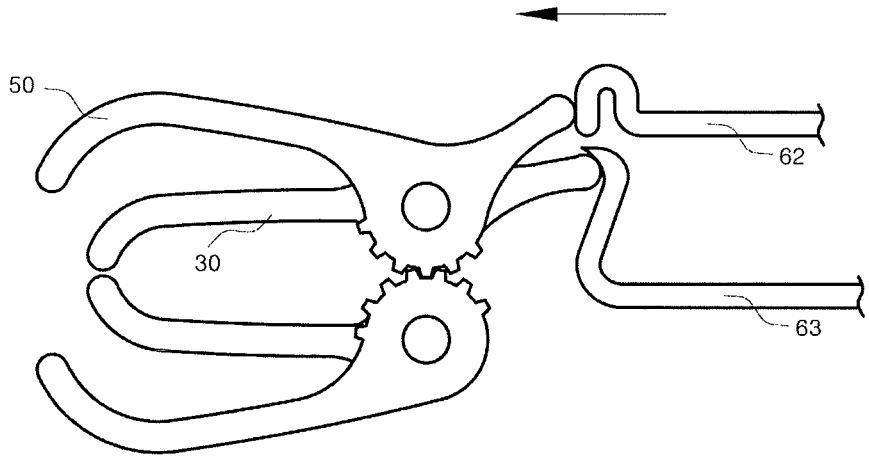
FIG. 9 is a view illustrating another operation of the inner and outer grips by the movement of the manipulating portion of FIG. 1.
Figure 10:
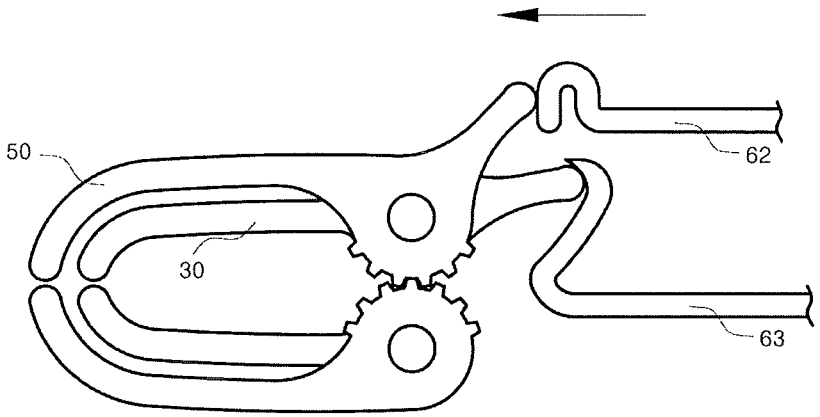
FIG. 10 is a view illustrating a further operation of the inner and outer grips by the movement of the manipulating portion of FIG. 1.

As shown in FIGS. 8 to 10, if the manipulating portion 60 moves towards the support 20, first, the lower pressurizing portion 63 comes into contact with the inner grip lever 34 to close the inner grip 30. When the manipulating portion continues to move forwards, the upper pressurizing portion 62 comes into contact with the outer grip lever 54 to close the outer grip 50.

Here, if the manipulating portion 60 continues to move, the inner grip 30 is first closed completely, thus holding the natural eyelashes 1. Subsequently, the outer grip 50 is completely closed, so that heat is applied to the adhesive between the natural eyelashes 1 and the false eyelashes 2 to attach the false eyelashes 2 to the natural eyelashes 1.

In this case, the lower pressurizing portion 63 is partially deformed to increase the force for gripping the natural eyelashes 1.

Thereafter, if the load is removed from the manipulating portion 60, the manipulating portion 60, the inner grip 30 and the outer grip 50 return to their original states.

Figure 11:
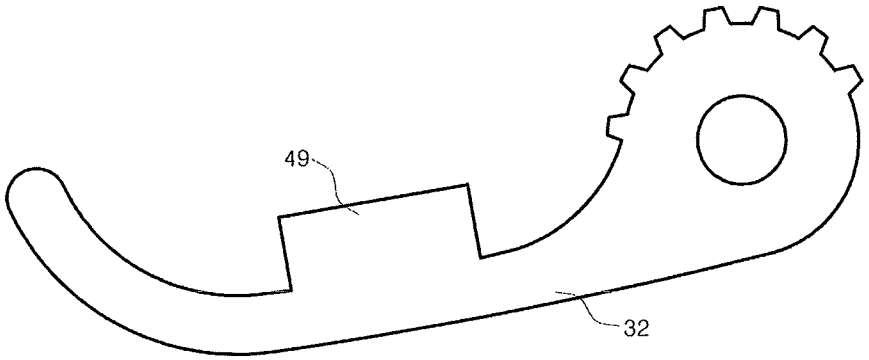
FIG. 11 is a front view illustrating another configuration of a lower inner grip of FIG. 1.

Meanwhile, a projecting portion 49 may be formed on a side of the lower outer grip 52 or the lower inner grip 32, as shown in FIG. 11.

Figure 12:
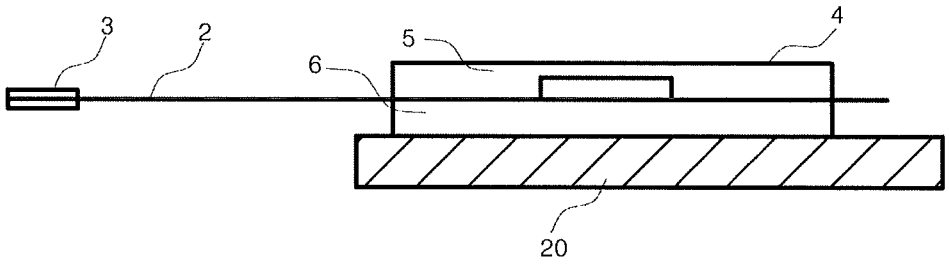
FIG. 12 is a view illustrating a holding structure for false eyelashes of FIG. 1.

Since the false eyelashes 2 comprise a plurality of strands, they are held by a holder 4 as shown in FIG. 12. The holder 4 includes an upper member 5 and a lower member 6. The false eyelashes 2 containing the adhesive 3 are located between the upper member 5 and the lower member 6. The upper and lower members must be separated from each other after the extension procedure. Here, the projecting portion 49 separates the upper member 5 and the lower member 6 from each other.

If necessary, a bottom surface of the holder 4 is configured to be fastened to the support 20. For example, it is formed to have a coupling structure in a slide type or a press-fit type using a protrusion or the like. Further, if a side of the upper member 5 is formed to protrude when the upper member 5 is also coupled to the lower member 6 through press fitting using the protrusion or the like, the upper member 5 is separated from the lower member 6 by the projecting portion 49, and consequently the false eyelashes 2 are separated from the holder 4.

Here, precise separation is ensured when a coupling force of the lower member 6 with the support 20 is greater than that of the upper member 5 with the lower member 6.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

DESCRIPTION OF REFERENCE NUMERALS

| | |
|---|---|
| 1: natural eyelashes | 2: false eyelashes |
| 3: adhesive | 4: holder |
| 5: upper member | 6: lower member |
| 10: body | 11: power cord |
| 12: upper protrusion | 13: lower protrusion |
| 20: support | 30: inner grip |
| 31: upper inner grip | 32: lower inner grip |
| 33: rotary hole | 34: inner grip lever |
| 35: rotary hole | 41, 42: inner grip gear |
| 43: inner grip spring | 44, 45: outer grip gear |
| 46: outer grip spring | 50: outer grip |
| 51: upper outer grip | 52: lower outer grip |
| 53: rotary hole | 54: outer grip lever |
| 55: rotary hole | 60: manipulating portion |
| 61: spring | 62: upper pressurizing portion |
| 63: lower pressurizing portion | |
| 100: attaching device for extension eyelashes | |

The invention claimed is:

1. An attaching device for extension eyelashes adapted to attach false eyelashes to natural eyelashes by overlapping the false eyelashes containing an adhesive with the natural eyelashes and applying heat to the adhesive, comprising:

a body defining a space therein, and shaped to be held by a hand;

a support formed on an end of the body to support the false eyelashes;

an inner grip shaped to surround the support, and gripping the natural eyelashes and the false eyelashes;

an outer grip shaped to surround the inner grip, and further gripping the natural eyelashes and the false eyelashes that are gripped by the inner grip, the outer grip applying heat to the adhesive contained in the false eyelashes; and a manipulating portion slidably coupled to an exterior of the body, and moved to sequentially operate the inner grip and the outer grip, wherein the inner comprises:

an upper inner grip including a rotary hole that is rotatably coupled to an upper protrusion formed on the body;

a lower inner grip including a rotary hole that is rotatably coupled to a lower protrusion formed on the body;

an inner grip lever formed on an end of the upper inner grip; and an inner grip gear formed on each of contact portions of the upper inner grip with the lower inner grip, the inner grip lever rotating in a direction of closing the upper inner grip and the lower inner grip relative to each other, in conjunction with a forward movement of the manipulating portion.

2. The attaching device according to claim 1, further comprising:

a rotary spring provided between the upper inner grip and the body, or between the upper inner grip and the lower inner grip, the rotary spring keeping the upper inner grip and the lower inner grip open if there is no additional manipulation.

3. The attaching device according to claim 2, wherein the outer grip comprises:

an upper outer grip including a rotary hole that is rotatably coupled to an upper protrusion formed on the body;

a lower outer grip including a rotary hole that is rotatably coupled to a lower protrusion formed on the body;

an outer grip lever formed on an end of the upper outer grip; and an outer grip gear formed on each of contact portions of the upper outer grip with the lower outer grip, the outer grip lever rotating in a direction of closing the upper outer grip and the lower outer grip relative to each other, in conjunction with a forward movement of the manipulating portion.

4. The attaching device according to claim 3, further comprising:

a rotary spring provided between the upper outer grip and the body, or between the upper outer grip and the lower outer grip, the rotary spring keeping the upper outer grip and the lower outer grip open if there is no additional manipulation.

5. The attaching device according to claim 3, wherein each of the inner grip gear and the outer grip gear comprises a plurality of gears, the outer grip gear being at an outer position and the inner grip gear being at an inner position in a longitudinal direction of the protrusion.

6. The attaching device according to claim 3, wherein the manipulating portion comprises an upper pressurizing portion and a lower pressurizing portion, the upper pressurizing portion coming into contact with the outer grip lever, the lower pressurizing portion coming into contact with the inner grip lever.

7. The attaching device according to claim 6, wherein if the manipulating portion moves forwards, the lower pressurizing portion first comes into contact with the inner grip lever and then the upper pressurizing portion comes into contact with the outer grip lever.

8. The attaching device according to claim 7, wherein the lower pressurizing portion is deformed when the inner grip lever is not rotated any more, thus increasing a gripping force of the inner grip.

* * * * *